US011276978B2

(12) United States Patent
Sakaizawa et al.

(10) Patent No.: US 11,276,978 B2
(45) Date of Patent: Mar. 15, 2022

(54) ELECTRIC CONNECTOR MANUFACTURING METHOD AND ELECTRIC CONNECTOR

(71) Applicant: HIROSE ELECTRIC CO., LTD., Kanagawa (JP)

(72) Inventors: Tadashi Sakaizawa, Kanagawa (JP); Kenichi Naganuma, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 16/969,596

(22) PCT Filed: Jan. 30, 2019

(86) PCT No.: PCT/JP2019/003108
§ 371 (c)(1),
(2) Date: Aug. 13, 2020

(87) PCT Pub. No.: WO2019/167524
PCT Pub. Date: Sep. 6, 2019

(65) Prior Publication Data

US 2021/0066874 A1 Mar. 4, 2021

(30) Foreign Application Priority Data

Mar. 2, 2018 (JP) ..... JP2018-037693

(51) Int. Cl.
*H01R 13/405* (2006.01)
*H01R 43/24* (2006.01)
(Continued)

(52) U.S. Cl.
CPC ..... *H01R 43/24* (2013.01); *H01R 13/405* (2013.01); *H01R 13/514* (2013.01); *H01R 13/6586* (2013.01); *H01R 24/60* (2013.01)

(58) Field of Classification Search
CPC ..... H01R 43/20; H01R 43/24; H01R 13/405; H01R 13/514; H01R 13/6586; H01R 24/60
(Continued)

(56) References Cited

U.S. PATENT DOCUMENTS 6,093,061 A 7/2000 Varsik et al.
9,496,664 B2 11/2016 Little et al.
(Continued)

FOREIGN PATENT DOCUMENTS

CN 105098455 A 11/2015
CN 106252932 A 12/2016
(Continued)

OTHER PUBLICATIONS

Japanese Office Action (JPOA) dated Aug. 23, 2021 for the corresponding Japanese Patent Application No. 2018-037693 and its English machine translation.
(Continued)

*Primary Examiner* — Khiem M Nguyen
(74) *Attorney, Agent, or Firm* — Rankin, Hill & Clark LLP

(57) ABSTRACT

Provided is a method for manufacturing an electric connector. The electric connector is an electric connector having contact portions on both one surface and the other surface opposite to the one surface of a plate-shaped fitting portion that fits with a mating connector, and can accurately position a plurality of first terminals forming the contact portion on the one surface of the fitting portion and a plurality of second terminals forming a contact portion on the other surface of the fitting portion through a shield plate. The method for manufacturing the electric connector includes: a step of forming a primary molded portion in which a plurality of first contact portions is integrally provided by insert mold-
(Continued)

ing; a step of forming a secondary molded portion in which a plurality of second contact portions is integrally provided by insert molding; and a step of producing a housing by forming a tertiary molded portion in which the primary molded portion and the secondary molded portion are integrally provided by insert molding.

19 Claims, 12 Drawing Sheets

(51) Int. Cl.
*H01R 13/514* (2006.01)
*H01R 13/6586* (2011.01)
*H01R 24/60* (2011.01)

(58) Field of Classification Search
USPC ..... 439/736, 733.1
See application file for complete search history.

(56) References Cited

U.S. PATENT DOCUMENTS

| | | | |
|---|---|---|---|
| 9,653,850 | B1 | 5/2017 | Su et al. |
| 9,748,702 | B2 | 8/2017 | Little et al. |
| 10,074,927 | B1 | 9/2018 | Ono |
| 2002/0192988 | A1 | 12/2002 | Droesbeke et al. |
| 2012/0178292 | A1 | 7/2012 | Kumamoto et al. |
| 2015/0222059 | A1 | 8/2015 | Little et al. |
| 2015/0255925 | A1 | 9/2015 | Katayanagi |
| 2017/0047693 | A1 | 2/2017 | Little et al. |
| 2017/0133795 | A1 | 5/2017 | Guo et al. |
| 2018/0269620 | A1 | 9/2018 | Hayashi et al. |

FOREIGN PATENT DOCUMENTS

| | | | |
|---|---|---|---|
| JP | 9-69378 | A | 3/1997 |
| JP | 2001-217052 | A | 8/2001 |
| JP | 2002-334752 | A | 11/2002 |
| JP | 2003-22877 | A | 1/2003 |
| JP | 2012-142245 | A | 7/2012 |
| JP | 2015-170528 | A | 9/2015 |
| JP | 2017-37851 | A | 2/2017 |
| JP | 2017-59457 | A | 3/2017 |
| JP | 6217876 | B1 | 10/2017 |

OTHER PUBLICATIONS

Chinese Office Action (CNOA) dated Jul. 2, 2021 for the corresponding Chinese Patent Application No. 201980009538.X.

International Search Report (ISR) dated Apr. 9, 2019 filed in PCT/JP2019/003108.

ELECTRIC CONNECTOR MANUFACTURING METHOD AND ELECTRIC CONNECTOR

TECHNICAL FIELD

The present invention relates to a method for manufacturing an electric connector, and an electric connector, and more specifically, the method for manufacturing the electric connector having contact portions on both one surface and the other surface opposite to the one surface of a plate-shaped fitting portion that fits with a mating connector, and the electric connector.

BACKGROUND ART

For example, JP-A-2017-037851 describes an example of the method for manufacturing the electric connector having the above shape.

The electric connector includes a plurality of first terminals forming the contact portion on the one surface of the fitting portion and a plurality of second terminals forming the contact portion on the other surface of the fitting portion. A shield plate integrally formed with a housing is provided between the first terminals and the second terminals in order to reduce influence of noise and prevent plastic deformation or damage of the terminals.

This conventional manufacturing method generally includes two steps. The steps include a step of forming a primary molded portion in which the first terminals and the shield plate are integrally provided by insert molding, and a step of producing the housing by forming a secondary molded portion in which the primary molded portion and the second terminals are integrally provided by insert molding.

CITATION LIST

Patent Literature

PATENT LITERATURE 1: JP-A-2017-037851

SUMMARY OF INVENTION

Problems to be Solved by Invention

As electronic devices become multifunctional and more sophisticated, further improvement in transmission rate is required. It is effective to reduce the noise in order to improve the transmission rate. Providing the shield plate is also one method of reducing the noise. In this case, it is important to accurately position the first terminal and the second terminal while providing the shield plate. By accurately positioning them, it is possible to cancel crosstalk and reduce the noise more effectively even when a magnetic flux leaks from the shield plate.

However, in the above-described conventional method for manufacturing the electric connector, when the primary molded portion and the second terminals are insert-molded, the second terminals are positioned with respect to the primary molded portion with their terminal portions exposed. Therefore, this method has a problem that the second terminals cannot be accurately positioned with respect to the primary molded portion. More specifically, in order to accurately position the second terminals with respect to the primary molded portion, it is important to reliably hold the terminals by a mold so as to withstand a pressure during injection molding. However, along with downsizing of the device, the terminals are also downsized (for example, some terminals have a terminal length of about several millimeters). Therefore, with today's technology, it is impossible or difficult to reliably hold the terminals. As a result, there is a great possibility that the terminals will shake due to resin poured into the mold, and if the terminals are left exposed, it is difficult to accurately position the second terminals with respect to the first terminals and the shield plate which are provided in the primary molded portion.

The present invention has been made to solve the above-mentioned problems in the conventional art. An object of the present invention is to provide the method for manufacturing the electric connector as described below. The electric connector has the contact portions on both the one surface and the other surface opposite to the one surface of the plate-shaped fitting portion that fits with the mating connector. The first terminals that form the contact portion on the one surface of the fitting portion and the second terminals that form the contact portion on the other surface of the fitting portion are accurately positioned through the shield plate.

Solution to Problems

In order to solve the above-described problem, provided is a method for manufacturing an electric connector according to an aspect of the present invention, the electric connector including: a housing including a plate-shaped fitting portion that fits with a mating connector; a plurality of first terminals each having a first contact portion that is disposed on one surface of the fitting portion and can contact the mating connector when fitting with the mating connector; a plurality of second terminals each having a second contact portion that is disposed on the other surface opposite to the one surface of the fitting portion and can contact the mating connector when fitting with the mating connector; and a shield plate disposed between the first contact portion and the second contact portion. The method for manufacturing the electric connector includes: a step of forming a primary molded portion in which the first contact portions are integrally provided by insert molding; a step of forming a secondary molded portion in which the second contact portions are integrally provided by insert molding; and a step of producing the housing by forming a tertiary molded portion in which the primary molded portion and the secondary molded portion are integrally provided by insert molding. The shield plate is integrally provided with the first contact portions by insert molding as a part of the primary molded portion, or integrally provided with the second contact portions by insert molding as a part of the secondary molded portion, or integrally provided with the primary molded portion and the secondary molded portion by insert molding as a part of the tertiary molded portion.

According to a manufacturing method of this aspect, the primary molded portion integrally provided with the first contact portions of the first terminals and the secondary molded portion integrally provided with the second contact portions of the second terminals are formed in advance. Therefore, when forming the tertiary molded portion, by simply combining the primary molded portion and the secondary molded portion, the first terminals and the second terminals, especially the first contact portions and the second contact portions thereof can be accurately positioned through the shield plate.

In the manufacturing method according to the aspect, it is preferred that, in the step of forming the primary molded portion, a first engaging portion is integrally formed as a part of the primary molded portion, in the step of forming the secondary molded portion, a second engaging portion is integrally formed as a part of the secondary molded portion, and in the step of producing the housing by forming the tertiary molded portion, the first engaging portion and the second engaging portion are engaged with each other. Here, the engaging portion may be a protrusion or a recess.

By utilizing the engaging portion, it is possible to position the first terminals and the second terminals, particularly the first contact portions and the second contact portions thereof more accurately and easily.

Further, in the manufacturing method according to the aspect, it is preferred that the step of producing the housing by forming the tertiary molded portion includes filling resin into a gap formed between the primary molded portion and the secondary molded portion at a peripheral edge of the one surface and the other surface of the fitting portion. The peripheral edge may be substantially U-shaped in a plan view.

The primary molded portion and the secondary molded portion can be more firmly fixed by filling the resin into the gap in the peripheral edge, which is formed when the primary molded portion and the secondary molded portion are combined.

Further, in the manufacturing method according to the aspect, the step of forming the primary molded portion may include filling resin into a gap between the first contact portions adjacent to each other, and/or the step of forming the secondary molded portion includes filling the resin into a gap between the second contact portions adjacent to each other. In this case, a resin portion filled in the gap between the first contact portions adjacent to each other may protrudes from the first contact portions to a side opposite to the secondary molded portion in the thickness direction of the fitting portion, and/or a resin portion filled in the gap between the second contact portions adjacent to each other may protrude from the second contact portions to a side opposite to the primary molded portion in the thickness direction of the fitting portion.

By providing such a filled portion, it is possible to fix the first contact portion and the second contact portion, which are easily peeled off, more reliably.

Moreover, in the manufacturing method according to the aspect, it is preferred that the step of forming the primary molded portion includes covering an end portion on a side fitting with the mating connector of the first terminal with resin on the side fitting with the mating connector, and/or the step of forming the secondary molded portion includes covering an end portion on a side fitting with the mating connector of the second terminal with the resin on the side fitting with the mating connector.

The first terminal and the second terminal are often peeled off at the end portion on the side fitting with the mating connector. Therefore, by reliably covering the end portions with the resin, it is possible to fix the first terminal and the second terminal, which are easily peeled off, more reliably.

In the manufacturing method according to the aspect, it is preferred that the step of producing the housing by forming the tertiary molded portion includes filling, in an end portion on a side fitting with the mating connector of the first terminal, resin in a recess formed on the secondary molded portion side from the end portion, in the thickness direction of the fitting portion, and/or the step of producing the housing by forming the tertiary molded portion includes filling, in an end portion on a side fitting with the mating connector of the second terminal, the resin in a recess formed on the primary molded portion side from the end portion, in the thickness direction of the fitting portion.

The recesses can be formed by holding the terminals by a mold when insert-molding the primary molded portion and the secondary molded portion. By filling the recesses with the resin when forming a tertiary molded portion 80, it is possible to fix the first terminal and the second terminal, which are easily peeled off, more reliably.

In the method for manufacturing the electric connector according to the aspect, the first terminal may have a first connecting portion exposed from the housing, and the step of forming the primary molded portion includes a step of bending the first connecting portions so that an array direction of the first contact portions and an array direction of the first connecting portions are perpendicular to each other, and/or the second terminal may have a second connecting portion exposed from the housing, and the step of forming the secondary molded portion includes a step of bending the second connecting portions so that an array direction of the second contact portions and an array direction of the second connecting portions are perpendicular to each other.

In the method for manufacturing the electric connector according to the aspect, in the step of forming the primary molded portion, the first connecting portions may be integrally held by a resin portion, and/or in the step of forming the secondary molded portion, the second connecting portions may be integrally held by the resin portion.

Further, in the method for manufacturing the electric connector according to the aspect, it is preferred that the first connecting portions integrally held are integrally bent with respect to the first contact portions, and/or the second connecting portions integrally held are integrally bent with respect to the second contact portions.

In the manufacturing method according to the aspect, it is preferred that, when the shield plate is provided integrally with the primary molded portion and the secondary molded portion as a part of the tertiary molded portion by insert molding, a first placement surface on which the shield plate is placed is formed in the primary molded portion in the step of forming the primary molded portion, and/or when the shield plate is provided integrally with the primary molded portion and the secondary molded portion as a part of the tertiary molded portion by insert molding, a second placement surface on which the shield plate is placed is formed in the secondary molded portion in the step of forming the secondary molded portion.

By providing the placement surface, the shield plate can be easily and reliably positioned at a predetermined position between the first terminal and the second terminal, for example, just at an intermediate position between them.

In the manufacturing method according to the aspect, it is preferred that the first placement surface is provided with a protrusion that defines a position of the shield plate in the first placement surface, in at least one of a fitting direction with the mating connector, an array direction of the first contact portions, and the thickness direction of the fitting portion, and/or the second placement surface is provided with a protrusion that defines a position of the shield plate in the second placement surface, in at least one of the fitting direction with the mating connector, an array direction of the second contact portions, and the thickness direction of the fitting portion.

By providing the protrusion, the position of the shield plate on the placement surface can be easily defined through collision with the protrusion.

In the manufacturing method according to the aspect, the first terminal may have a first coupling portion located between the first contact portion and the first connecting portion, and the first placement surface may be formed by at least a first resin portion integrally holding the first contact portions and a second resin portion integrally holding the first coupling portions, the resin portions being separated from each other, and/or the second terminal may have a second coupling portion located between the second contact portion and the second connecting portion, and the second placement surface may be formed by at least a first resin portion integrally holding the second contact portions and a second resin portion integrally holding the second coupling portions, the resin portions being separated from each other.

With such a configuration, a metal plate for forming the terminal can be, for example, freely cut even after the resin portions are provided.

An electric connector according to an aspect of the present invention includes: a housing including a plate-shaped fitting portion that fits with a mating connector; a plurality of first terminals each having a first contact portion that is disposed on one surface of the fitting portion and can contact the mating connector when fitting with the mating connector; a plurality of second terminals each having a second contact portion that is disposed on the other surface opposite to the one surface of the fitting portion and can contact the mating connector when fitting with the mating connector; and a shield plate disposed between the first contact portion and the second contact portion. A part of the shield plate is exposed in a plate shape from the housing.

In the electric connector according to the aspect, a part of the shield plate may be on the same plane as a shield portion of the shield plate disposed between the first contact portion and the second contact portion.

In the electric connector according to the aspect, the first terminal may have a first connecting portion exposed from the housing, and the second terminal may have a second connecting portion exposed from the housing, and a part of the shield plate may be exposed from a portion other than the fitting portion and exposed portions of the first connecting portion and the second connecting portion in a peripheral edge surrounding a plate thickness of the shield plate of the housing.

Further, an electric connector according to another aspect of the present invention includes: a housing including a plate-shaped fitting portion that fits with a mating connector; a plurality of first terminals each having a first contact portion, and a first coupling portion coupling the first contact portion and a first connecting portion; a plurality of second terminals each having a second contact portion, and a second coupling portion coupling the second contact portion and a second connecting portion; and a shield plate disposed between the first contact portion and the second contact portion. The housing includes: a first holding portion made of resin, which integrally holds the first contact portions, a second holding portion made of the resin, which integrally holds the second contact portions, and a third holding portion made of the resin, which integrally holds the two holding portions, the first coupling portion, the second coupling portion, and the shield plate.

Effects of Invention

According to the present invention, the following method for manufacturing the electric connector is provided. The electric connector has the contact portions on both the one surface and the other surface opposite to the one surface of the plate-shaped fitting portion that fits with the mating connector. It is possible to accurately position the first terminals that form the contact portion on the one surface of the fitting portion and the second terminals that form the contact portion on the other surface of the fitting portion through the shield plate.

DESCRIPTION OF EMBODIMENTS

Hereinafter, a preferred embodiment of the present invention will be described with reference to the accompanying drawings. For convenience of description, only the preferred embodiment will be illustrated. Of course, there is no intent to limit the invention by the embodiment.

Figure 1:
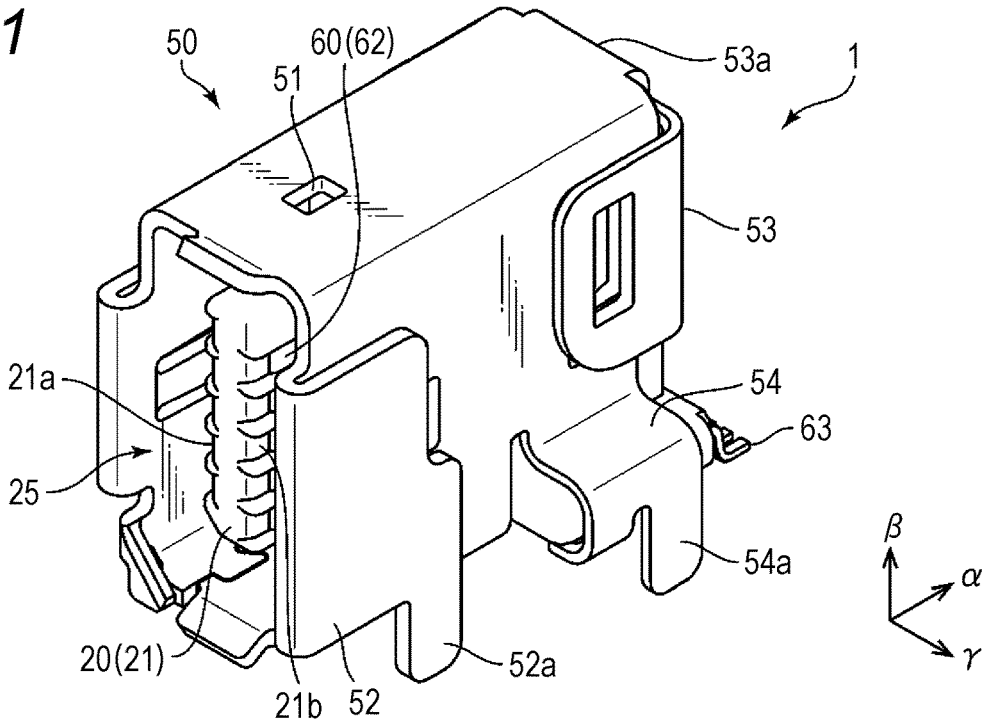
FIG. 1 is a perspective view illustrating an example of an electric connector that can be manufactured by a manufacturing method of the present invention.
Figure 2:
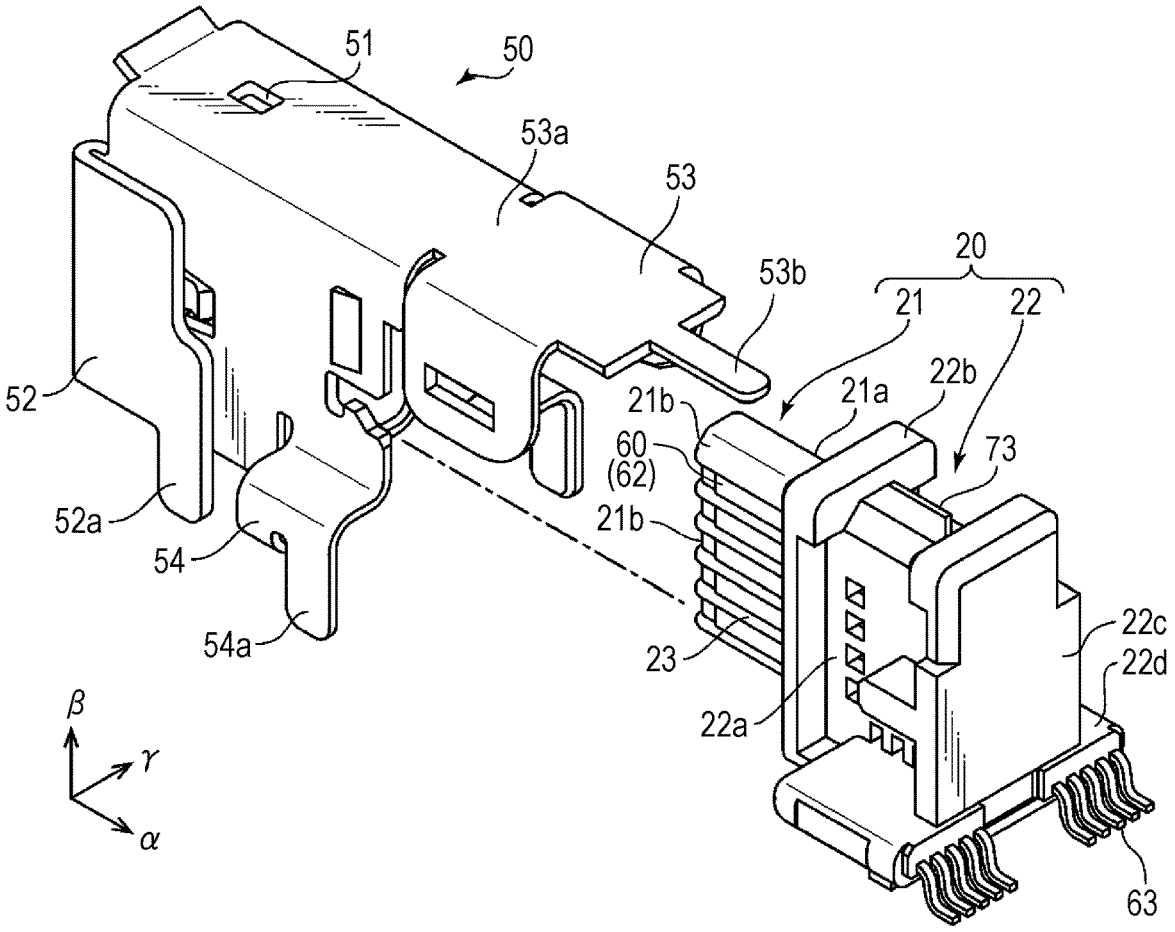
FIG. 2 is a schematic perspective view illustrating an internal structure of the electric connector of FIG. 1.
Figure 3:
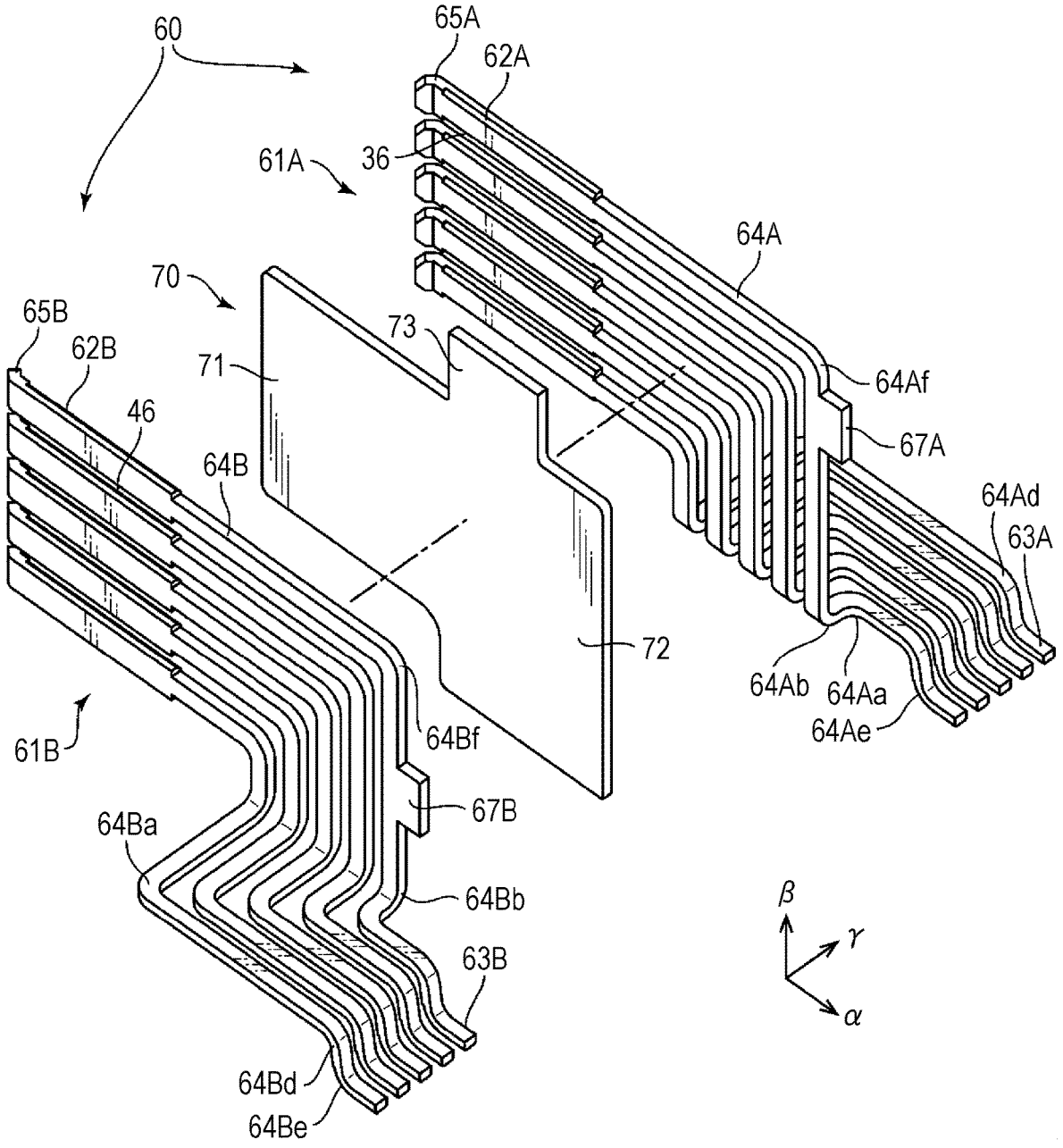
FIG. 3 is a schematic perspective view illustrating the internal structure of the electric connector of FIG. 1.

FIG. 1 is a perspective view illustrating an example of an electric connector 1 that can be manufactured by a manufacturing method of the present invention, and FIGS. 2 and 3 are schematic perspective views illustrating its internal structure.

The electric connector 1 has a substantially bilaterally symmetrical shape. The electric connector 1 mainly includes a resin housing 20, a plurality of terminals 60 and a shield plate 70 integrally molded with the housing 20, and a metal shell 50 attached to an outside of the housing 20. FIG. 2 is a perspective view illustrating their state before the shell 50 is attached to the housing 20. FIG. 3 is a perspective view of the terminals 60 and the shield plate 70 integrally molded with the housing 20.

In the electric connector 1, the shell 50 and the terminals 60 are used in a state of being fixed to a substrate (not shown), for example, by soldering. A fitting port 25 is provided on a front surface of the electric connector 1. By inserting a part of a mating connector (not shown) into the fitting port 25, connection with the mating connector can be realized.

The shell 50 covers the outside of the housing 20 on almost all surfaces except the fitting port 25. A hole 51 is provided on a top surface of the shell 50. When a part of the mating connector is inserted into the fitting port 25, a locking protrusion of the mating connector can be removably locked in the hole 51. The locking protrusion is locked in the hole 51, so that the mating connector is prevented from coming off from the electric connector 1.

Folded portions 52 are provided on left and right edges of the fitting opening 25 of the shell 50 to ensure strength of the shell 50. Legs 52*a* provided downward of the folded portions 52 are soldered while being penetrated through through-holes of the substrate. Legs 54*a* provided downward of portions 54 protruding left and right on a back surface of the shell 50 are also soldered while being penetrated through through-holes of the substrate. Through these soldering, the shell 50 is fixed to the substrate together with the housing 20 and is grounded to the substrate.

The housing 20 is mounted inside the shell 50 from the back surface of the shell 50. A back surface of the housing 20 is closed by bending a closing lid 53 of the shell 50 downward at a bent portion 53*a*. An extension portion 53*b* extending from the closing lid 53 is soldered while being penetrated through a through-hole of the substrate, like the legs 52*a* and the legs 54*a*.

The housing 20 includes a main body portion 22 and a fitting port 21. The fitting portion 21 protrudes in a fitting direction "α" toward a front side of the main body portion 22, that is, a side fitting with the mating connector.

The main body 22 includes a vertically extending plate-shaped base 22*a*, a front plate 22*b* vertically extending in a direction perpendicular to the base 22*a* on a front side of the base 22*a*, a back plate 22*c* vertically extending in a direction perpendicular to the base 22*a* on a back side of the base 22*a*, and a bottom plate 22*d* that is perpendicular to all of the base 22*a*, the front plate 22*b*, and the back plate 22*c* and supports a part of the base 22*a* and a bottom of the back plate 22*c*.

The fitting portion 21 is a thick-walled plate-shaped member provided further on a front side of the front plate 22*b*. A plurality of, here five, terminals 60 is provided with a part (contact portion 62) of each terminal 60 being exposed, on each of one plate surface 21*a* of the fitting portion 21 and the other plate surface 21*b* opposite to the one surface. When fitting with the mating connector (not shown), the contact portions 62 contact predetermined portions of corresponding terminals provided on the mating connector, so that they are electrically connected to each other.

The terminals 60 include a set of a plurality of first terminals 61A arranged on the one plate surface 21*a* side of the fitting portion 21 and a set of a plurality of second terminals 61B arranged on the other plate surface 21*b* side of the fitting portion 21. Each set is formed by punching and bending a single metal plate. The first terminals 61A can include two sets of pair terminals each including two adjacent terminals. Similarly, the second terminals 61B can include two sets of pair terminals each including two adjacent terminals.

The first terminals 61A each includes a first contact portion 62A contacting a predetermined portion of a corresponding connector of the mating connector when fitting with the mating connector, a first connecting portion 63A connected to the substrate, and a first coupling portion 64A for coupling the first contact portion 62A and the first connecting portion 63A. Similarly, the second terminal 61B also includes a second contact portion 62B, a second connecting portion 63B, and a second coupling portion 64B.

The first contact portion 62A and the second contact portion 62B are arranged in the fitting portion 21. In order to contact the mating connector, each first contact portion 62A is provided with the plate surface 21*a* side being exposed to an outside of the fitting portion 21, and each second contact portion 62B is provided with the plate surface 21*b* side being exposed to the outside of the fitting portion 21. In order to increase an effective fitting length with the mating connector, each of the first contact portion 62A and the second contact portion 62B extends substantially straight in the fitting direction "α" with the mating connector. However, in order to smoothly contact the mating connector, end portions 65A and 65B on the side fitting with the mating connector are slightly bent toward the shield plate 70.

In the fitting portion 21, the first contact portions 62A included in the set of the first terminals 61A are arrayed spaced from each other by equal pitches in an array direction "β". Similarly, the second contact portions 62B included in the set of the second terminals 61B are arrayed spaced from each other by equal pitches in the array direction "β". The sets have a substantially mirror image relationship with each other with the shield plate 70 as a center regarding their shape and arrangement. However, in order to prevent cross-talk, they are staggered from each other when they are combined.

The first connecting portion 63A and the second connecting portion 63B are provided exposed from the housing 20 in order to be connected to the substrate. They extend horizontally and substantially straight with respect to a surface of the substrate to be connected by soldering. The first connecting portions 63A included in the set of the first terminals 61A are arrayed spaced from each other by equal pitches in an array direction "γ". Similarly, the second connecting portions 63B included in the set of the second terminals 61B are arrayed spaced from each other by equal pitches in the array direction "γ". The array direction "γ" of the first connecting portions 63A and the array direction "γ" of the second connecting portions 63B are parallel to a thickness direction "β" of the fitting portion 21.

Substantially all the first coupling portion 64A and the second coupling portion 64B are embedded inside the housing 20, except for a vicinity of a boundary with the first connecting portion 63A and the second connecting portion 63B. The first coupling portion 64A includes curved portion 64Aa, 64Af and bent portions 64Ab, 64Ad, 64Ae. The second coupling portion 64B includes curved portion 64Ba, 64Bf and bent portions 64Bb, 64Bd, 64Be. The curved portion is formed when the metal plate is punched, and the bent portion is formed by subsequent bending. By having the curved portions and the bent portions, the array direction "β" of the first contact portions 62A and the array direction "γ" of the first connecting portions 63A are substantially perpendicular to each other. Similarly, the array direction "β" of the second contact portions 62B and the array direction "γ" of the first connecting portions 63B are substantially perpendicular to each other.

The shield plate 70 is used to shield the first terminal 61A and the second terminal 61B. The shield plate 70 mainly includes a substantially rectangular first shield portion 71 and a substantially rectangular second shield portion 72. The first shield portion 71 is disposed between the first contact portion 62A and the second contact portion 62B, and shields them. The second shield portion 72 is particularly disposed between a vertically extending portion of the first coupling portion 64A and a vertically extending portion of the second coupling portion 64B, and shields them. The first terminal 61A and the second terminal 61B are effectively shielded in almost all the portions by the shield plate 70.

An example of a method for manufacturing the electric connector according to the present invention will be described with reference to FIGS. 4 to 14. As the example, the method for manufacturing the electric connector 1 illustrated in FIG. 1 and the like will be described. According to the present invention, not only the electric connector 1 but also various shapes of electric connectors can be manufactured.

Figure 12:
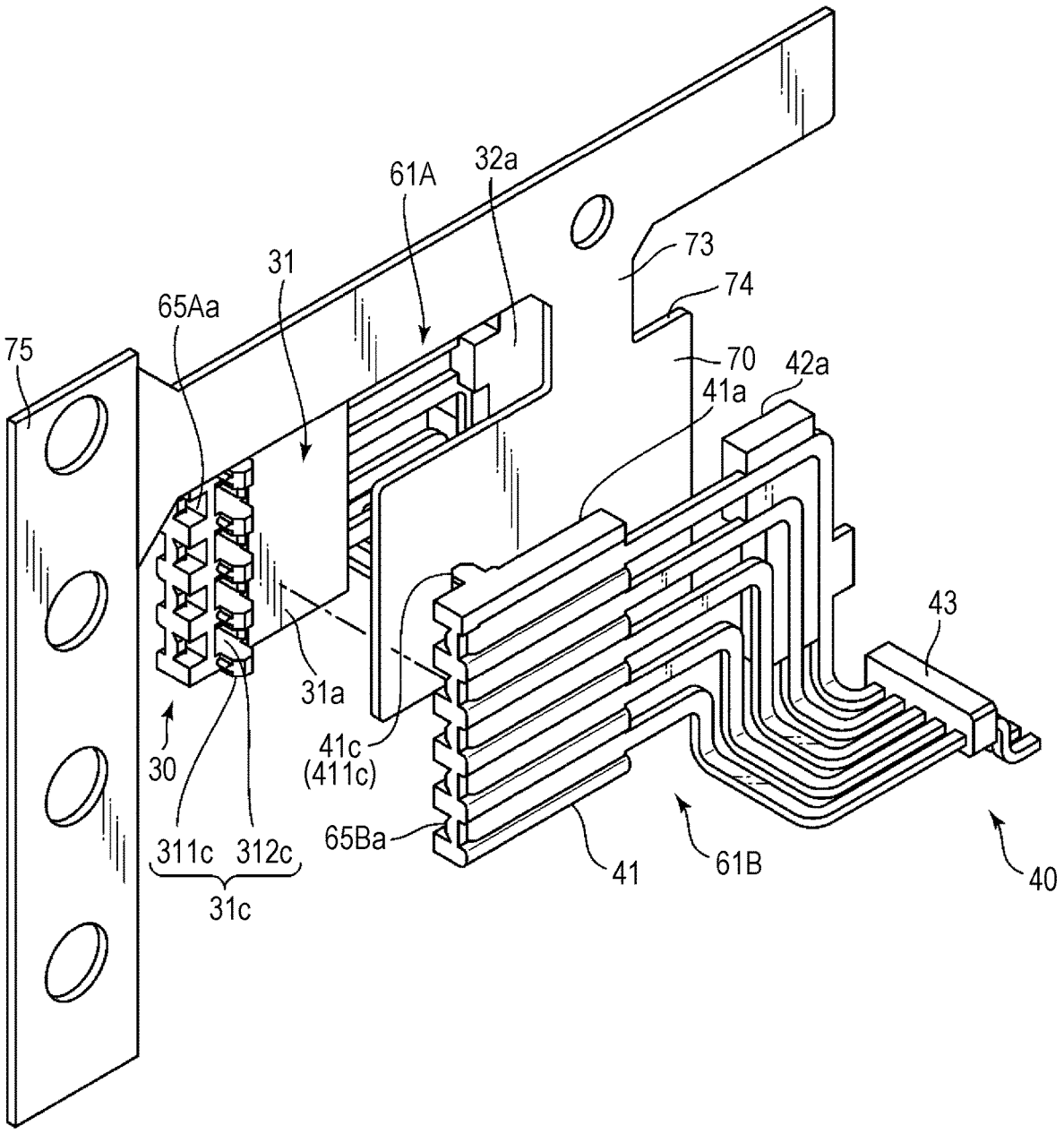
FIG. 12 is a view illustrating a step of producing a housing by forming a tertiary molded portion, and is a view illustrating a state before combining the primary molded portion and the secondary molded portion.
Figure 13:
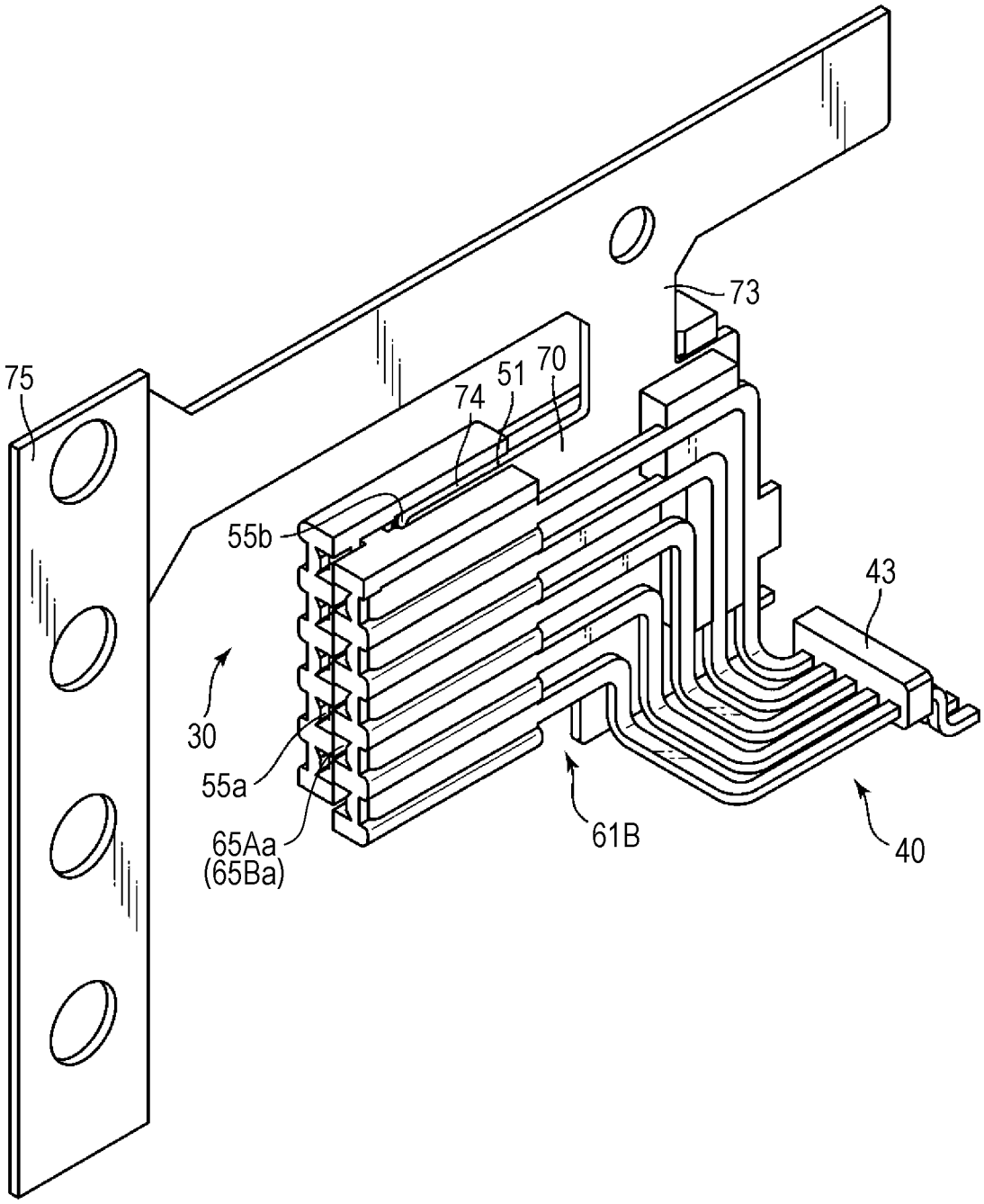
FIG. 13 is a view illustrating the step of producing the housing by forming the tertiary molded portion, and is a view illustrating a state after combining the primary molded portion and the secondary molded portion.
Figure 14:
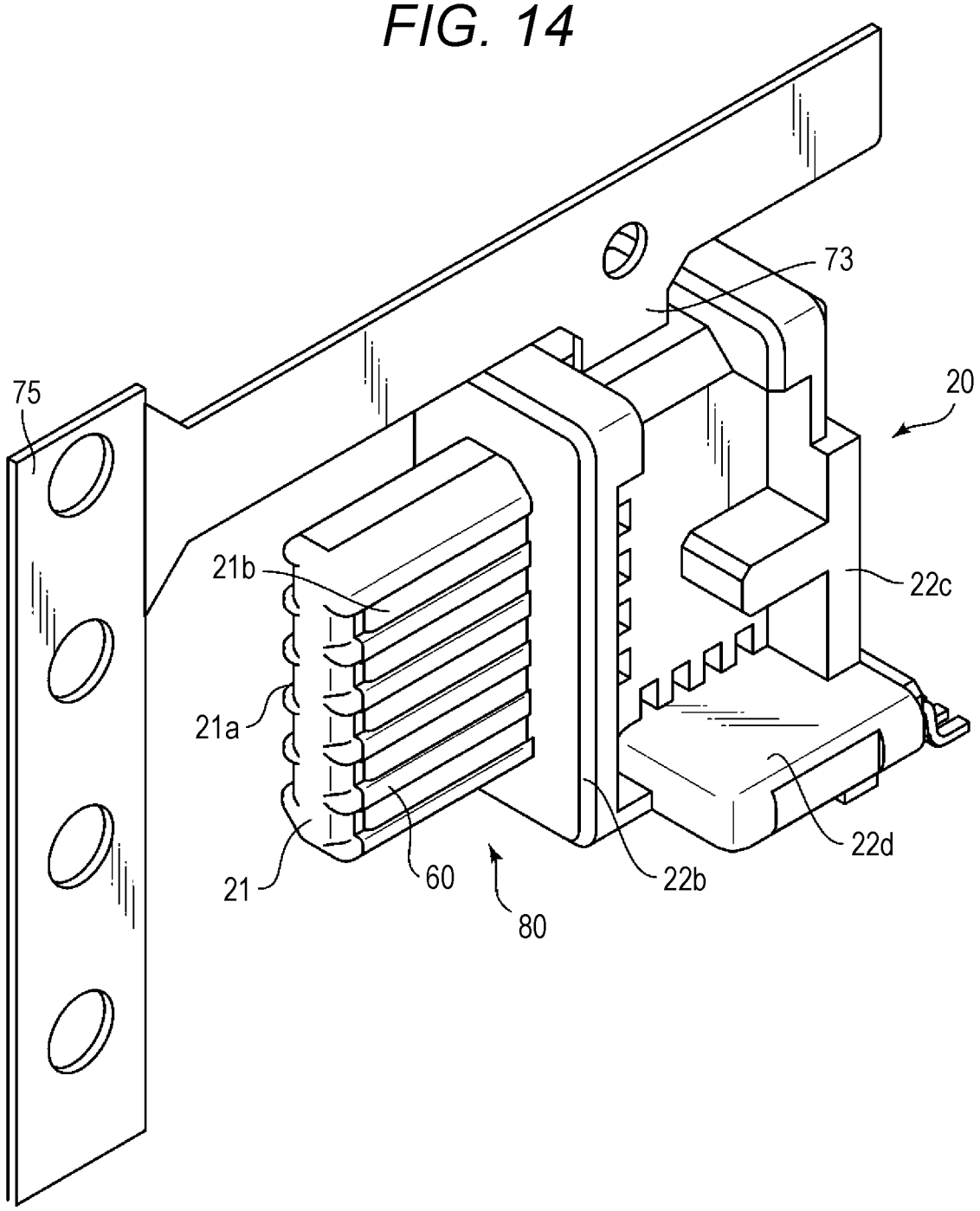
FIG. 14 is a view illustrating the step of producing the housing by forming the tertiary molded portion, and is a view illustrating a state in which the housing is produced by forming the tertiary molded portion.

FIGS. 4 to 7(*a*), 7(*b*), 7(*c*) are views illustrating a step of forming a primary molded portion 30 constituting a part of the housing 20 of the electric connector 1. FIGS. 8 to 11(*a*), 11(*b*), 11(*c*) are views illustrating a step of forming a secondary molded portion 40 constituting a part of the housing 20 of the electric connector 1, and are views respectively corresponding to FIGS. 4 to 7(*a*), 7(*b*), 7(*c*). FIGS. 12 to 14 are views illustrating a step of producing the housing 20 by forming a tertiary molded portion 80, in which the primary molded portion 30 formed through the steps of FIGS. 4 to 7(*a*), 7(*b*), 7(*c*) and the secondary molded portion 40 formed through the steps of FIGS. 8 to 11(*a*), 11(*b*), 11(*c*) are integrally provided with the shield plate 70 by insert molding.

First, with reference to FIGS. 4 to 7(*a*), 7(*b*), 7(*c*), a method for forming the primary molded portion 30 constituting a part of the housing 20 of the electric connector 1 will be described.

Figure 4:
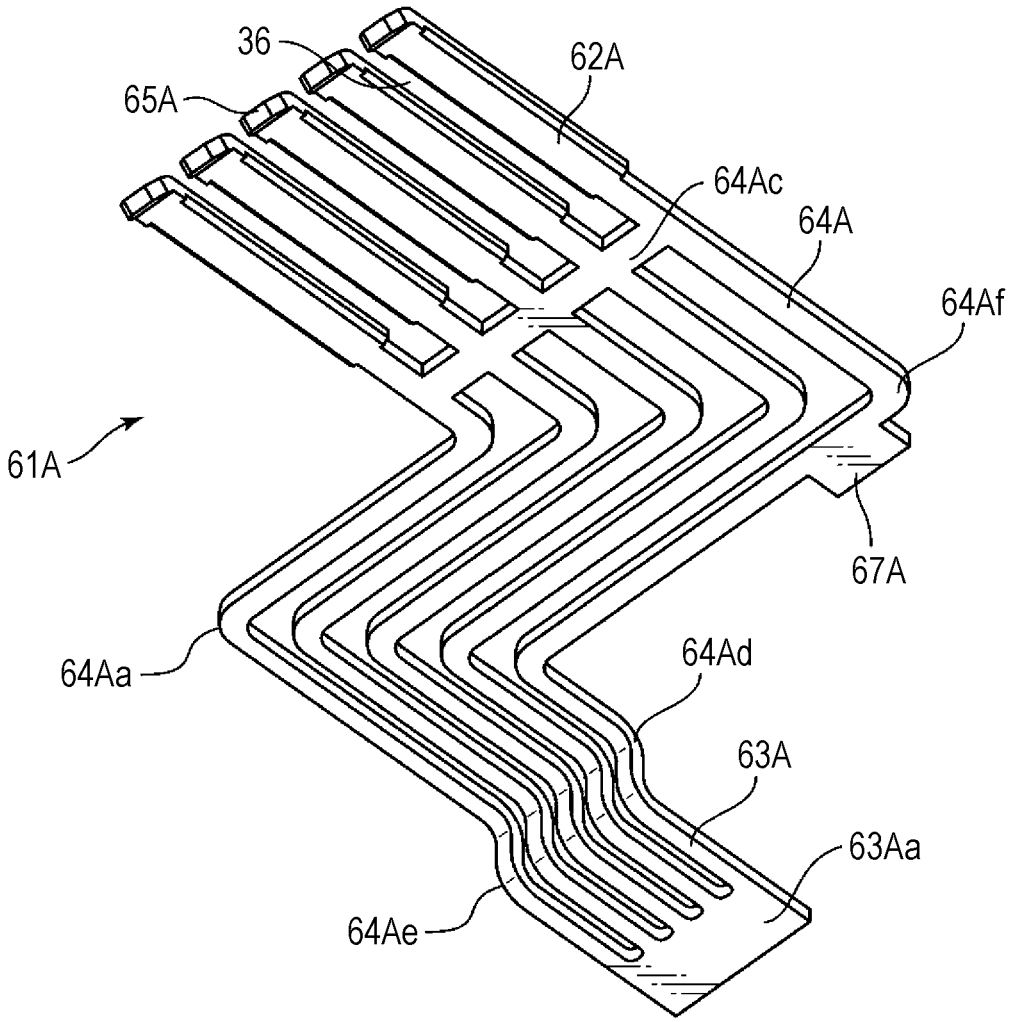
FIG. 4 is a view illustrating a step of forming a primary molded portion.

FIG. 4 illustrates a state of the metal plate punched and then subjected to a predetermined process, and is a perspective view of the metal plate as viewed from a fixed side with respect to the fitting portion 21. In forming the primary molded portion 30, first, one metal plate, which is still connected to a carrier (not shown) through a coupling portion 67A, is punched into a predetermined shape. Subsequently, the end portion 65A of the first contact portion 62A on the side fitting with the mating connector is bent, and the first coupling portion 64A is bent at substantially right angles respectively at the bent portions 64Ad and 64Ae. Thus, the first connecting portion 63A having a step with the first contact portion 62A is formed. At a stage in which the processes are performed, the first terminals 61A are still connected to each other by an intermediate coupling portion 64Ac and an end coupling portion 63Aa of the metal plate.

Figure 5:
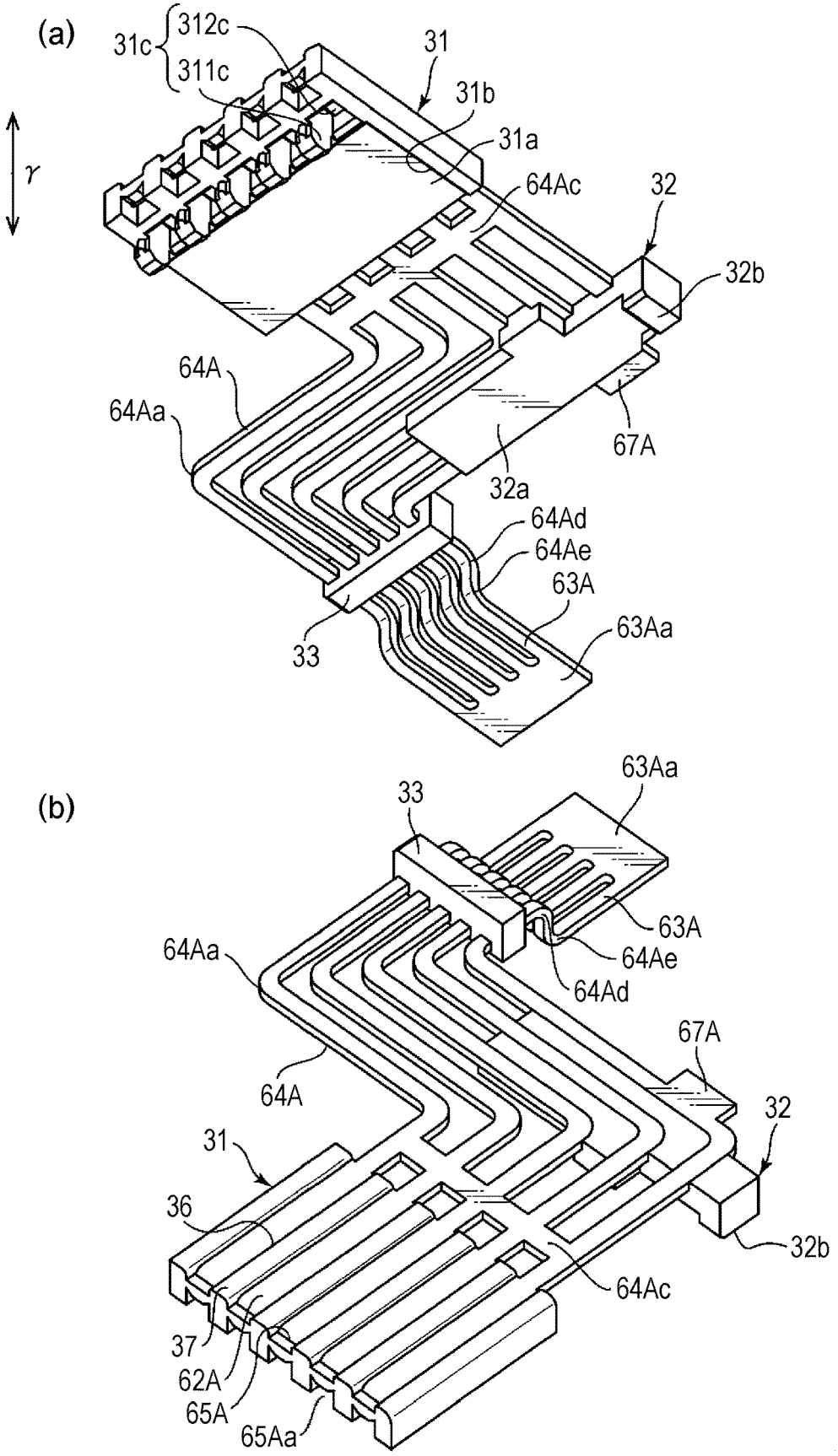
FIGS. 5(*a*) and 5(*b*) are views illustrating the step of forming the primary molded portion.

FIGS. 5(*a*) and 5(*b*) illustrate a state in which a plurality of resin portions is formed on the metal plate of FIG. 4. FIG. 5(*a*) is a perspective view of the state as seen from the fixed side with respect to the fitting portion 21 and corresponds to FIG. 4, and FIG. 5(*b*) is a perspective view of the state as seen from a side contacting the mating connector. By this process, a first resin portion (first holding portion) 31 that integrally holds the first contact portions 62A adjacent to each other is formed. Further, a second resin portion 32 that integrally holds the first coupling portions 64A adjacent to each other, for example, a vicinity of a middle of three of them is formed. Furthermore, a resin portion 33 that integrally holds a vicinity of an end portion of the first coupling portions 64A adjacent to each other is formed. The first contact portions 62A and the first coupling portions 64A are integrally provided by insert molding. Since the resin portions are formed, after the insert molding, the first terminals 61A are not separated from each other even if connection by the intermediate coupling portion 64Ac and the end coupling portion 63Aa of the metal plate is released. The first resin portion 31 and the second resin portion 32 are separated from each other so that the intermediate coupling portion 64Ac of the metal plate can be cut later.

In the insert molding, it is preferable to further fill a gap 36 between the adjacent first contact portions 62A with the resin. Thus, the adjacent first contact portions 62A can be fixed in a more stable state. Further, at this time, it is preferable that a resin portion 37 filled in the gap 36 is projected to a side opposite to the secondary molded portion 40 in the thickness direction "γ" of the fitting portion 21. Since this is projected, the first contact portion 62A can be more reliably fixed to the fitting portion 21. The thickness direction "γ" of the fitting portion 21 is the same as the array direction "γ" of the first connecting portions 63A and the second connecting portions 63B.

The first resin portion 31 and the second resin portion 32 may be respectively provided with placement surfaces 31*a* and 32*a* on which the shield plate 70 is placed. By providing the placement surfaces 31*a* and 32*a*, the shield plate 70 can be easily and reliably positioned at a predetermined position between the first terminal 61A and the second terminal 61B while keeping a predetermined distance from the terminals. Further, there may be provided protrusions 31*b* and 32*b* that project from the placement surfaces 31*a* and 32*a* to a placement side of the shield plate 70. By providing the protrusions 31*b* and 32*b*, a position of the shield plate 70 on the placement surfaces 31*a* and 32*a* is defined through collisions between the shield plate 70 and the protrusions 31*b* and 32*b*. Further speaking, the shield plate 70 collides with the protrusions 31*b* and 32*b*, so that the position of the shield plate 70 on the placement surfaces 31*a* and 32*a* can be defined in at least one of the fitting direction "α" with the mating connector, the array direction "β" of the first contact portions 62A, and the thickness direction "γ" of the fitting portion 21.

When combining the primary molded portion 30 and the secondary molded portion 40 in producing the housing 20 by forming the tertiary molded portion 80, in order to determine a positional relationship between the primary molded portion 30 and the secondary molded portion 40, the first resin portion 31 may be integrally provided with a first engaging portion 31*c* that can be engaged with a predetermined portion of the secondary molded portion 40 as a part of the primary molded portion 30. The first engaging portion 31*c* may be, for example, a recess 312*c* and a protrusion 311*c*. The irregularities are provided from an upper side to a lower side in the array direction "β" of the first contact portions 62A. The recess 312*c* can be provided at a position of the first contact portion 62A in the array direction "β". The protrusion 311*c* can be provided at a position of the resin portion 37 in the array direction "β".

Figure 6:
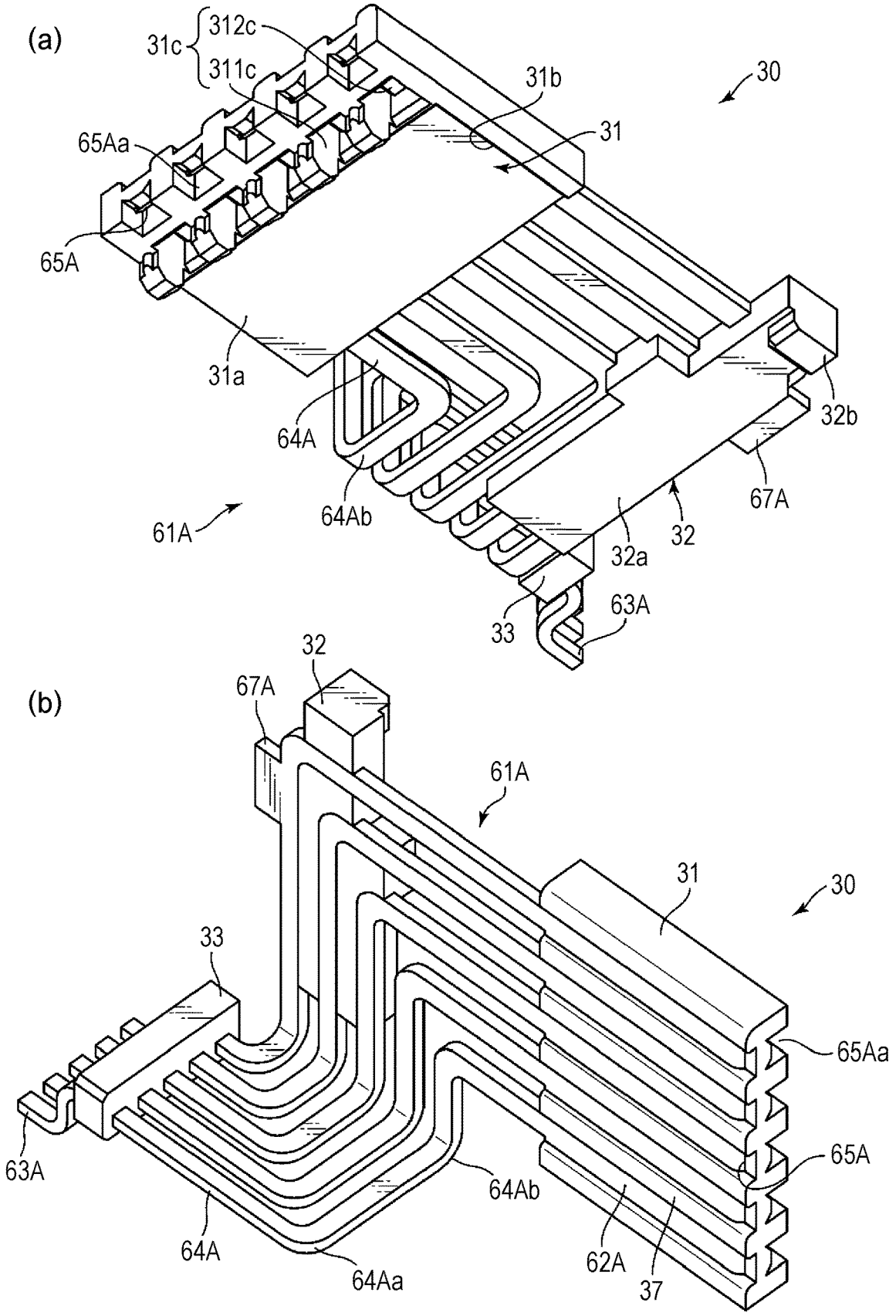
FIGS. 6(*a*) and 6(*b*) are views illustrating the step of forming the primary molded portion.
Figure 7:
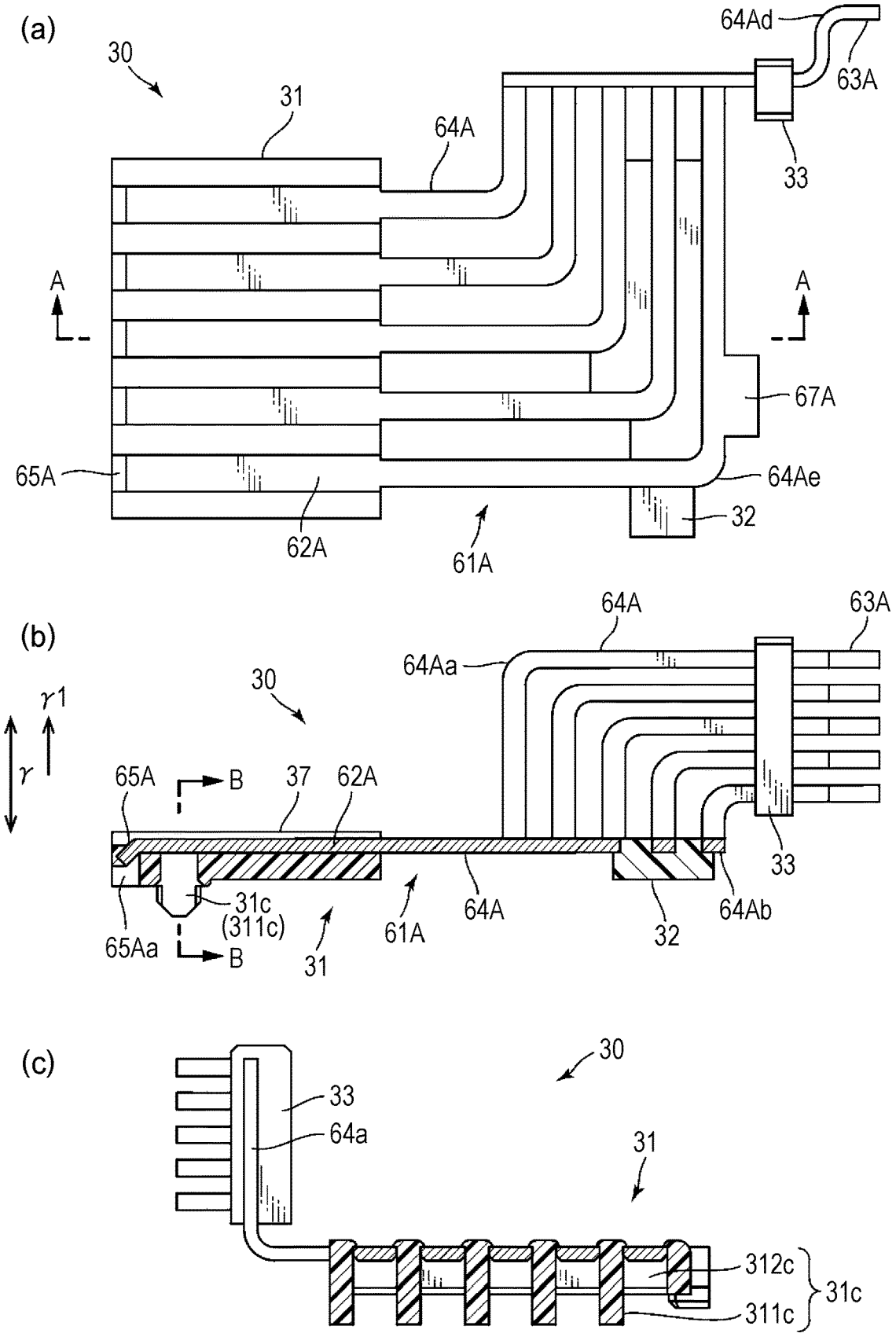
FIGS. 7(*a*), 7(*b*), 7(*c*) are views illustrating the step of forming the primary molded portion.

FIGS. 6(*a*), 6(*b*), 7(*a*), 7(*b*), 7(*c*) illustrate the primary molded portion 30 in a completed state by further providing the resin on the resin portions and the like of FIGS. 5(*a*) and 5(*b*). FIGS. 6(*a*) and 6(*b*) respectively correspond to FIGS. 5(*a*) and 5(*b*). FIG. 7(*a*) is a plan view of the primary molded portion 30, FIG. 7(*b*) is a cross-sectional view taken along a line A-A in FIG. 7(*a*), and FIG. 7(*c*) is a cross-sectional view taken along a line B-B in FIG. 7(*c*). At a stage illustrated in FIGS. 6(*a*), 6(*b*), 7(*a*), 7(*b*), 7(*c*), the intermediate coupling portion 64Ac and the end coupling portion 63Aa are cut out from the metal plate of FIGS. 5(*a*) and 5(*b*). As a result, the first terminals 61A are electrically disconnected from each other. However, since the first resin portion 31, the second resin portion 32, and the resin portion 33 are provided, each first terminal 61A is not physically completely separated from the other first terminals 61A. Thereafter, the vicinity of the middle of the first coupling portions 64A is bent at the bent portion 64Ab, so that the array direction "β" of the first contact portions 62A and the array direction "γ" of the first connecting portions 63A are perpendicular to each other, to complete the primary molded portion 30. In addition, when the step of FIGS. 5(*a*) and 5(*b*) is performed, the end portion 65A of the first terminal 61A on the side fitting with the mating connector, more specifically, the side fitting with the mating connector of the portion 65A slightly bent to the shield plate 70 side, is covered with the resin. As a result, peeling of the first terminal 61A from the resin is effectively prevented.

Figure 8:
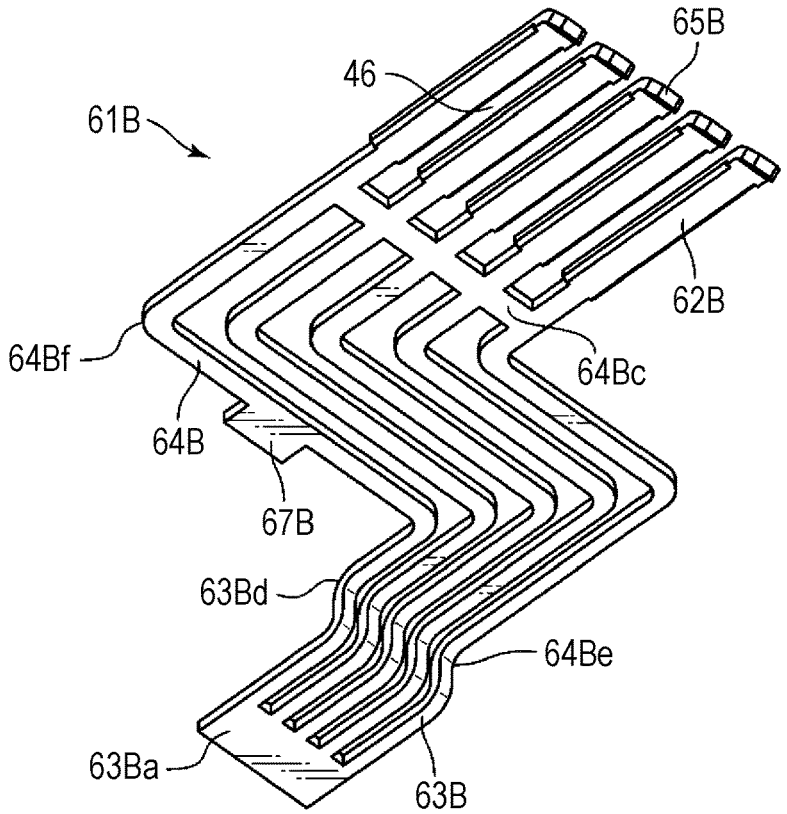
FIG. 8 is a view illustrating a step of forming a secondary molded portion and is a view corresponding to FIG. 4.
Figure 9:
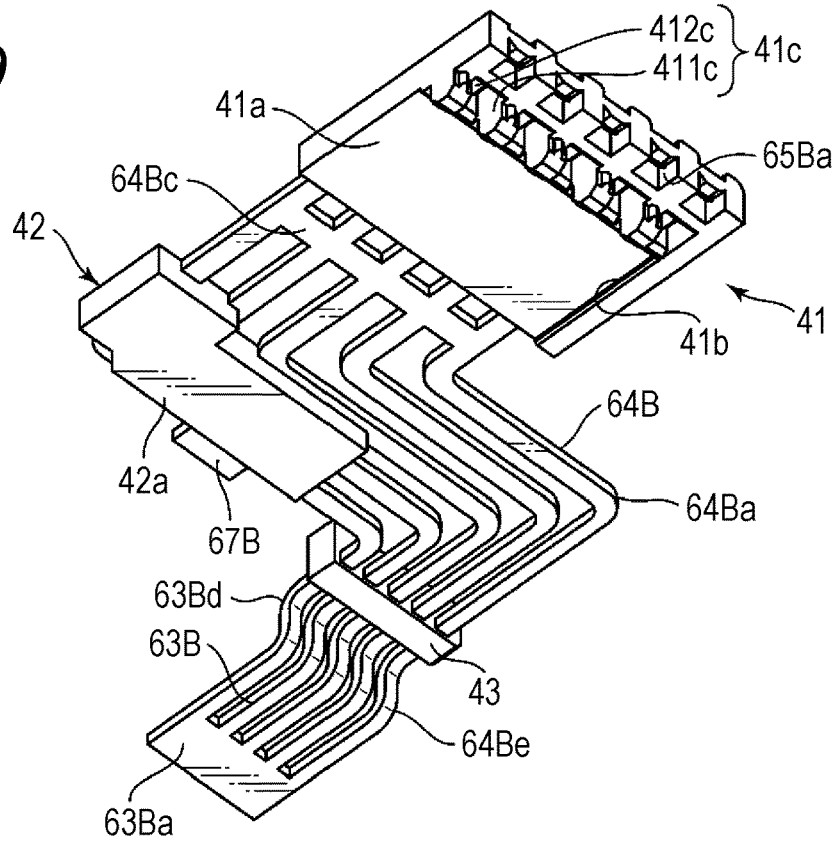
FIG. 9 is a view illustrating the step of forming the secondary molded portion and is a view corresponding to FIGS. 5(*a*) and 5(*b*).
Figure 10:
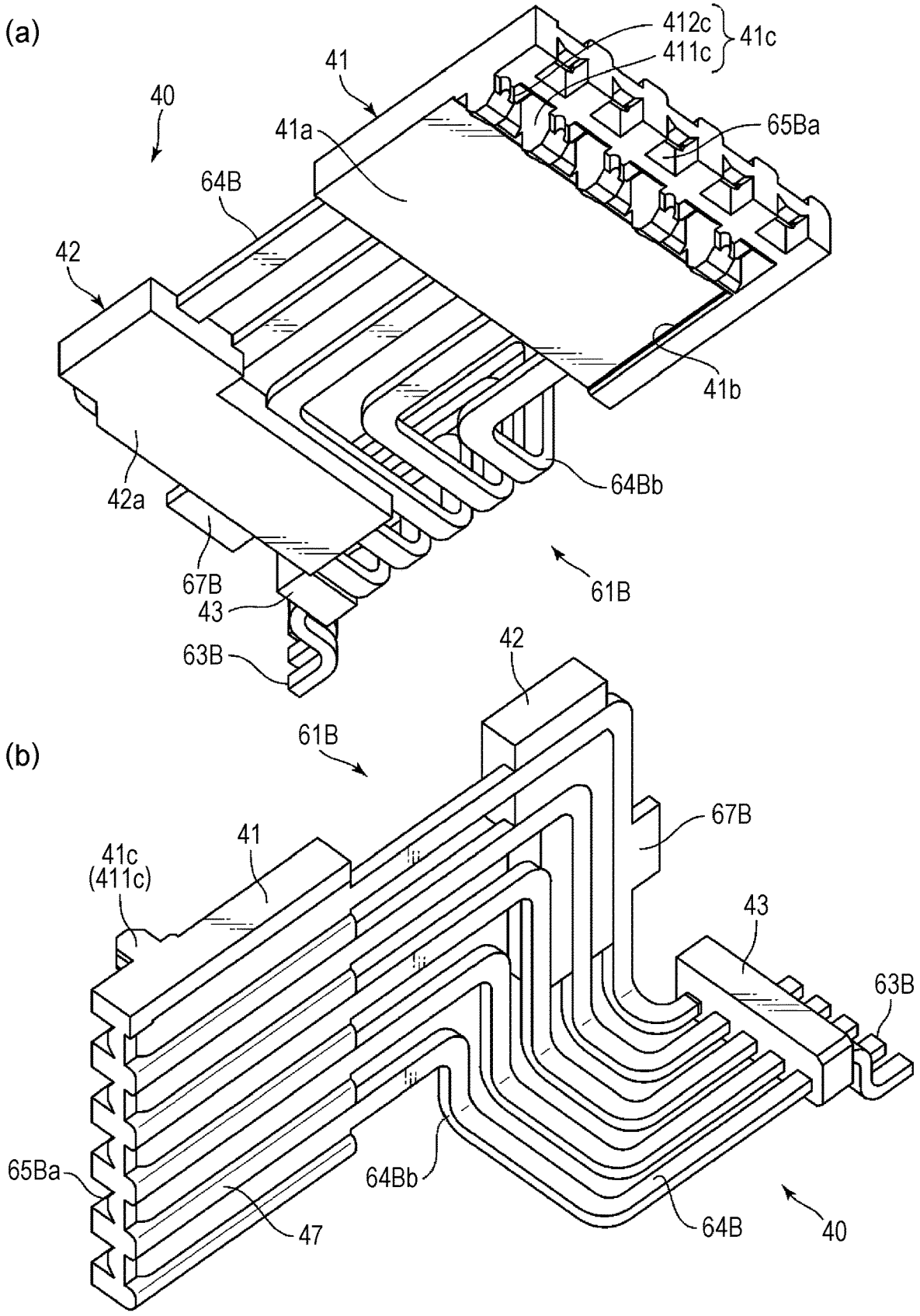
FIGS. 10(*a*) and 10(*b*) are views illustrating the step of forming the secondary molded portion and are views corresponding to FIGS. 6(*a*) and 6(*b*).

The secondary molded portion 40 is substantially in a mirror image relationship with the primary molded portion 30. Further, as is apparent from FIGS. 8 to 11(*a*), 11(*b*), 11(*c*), the step of forming the secondary molded portion 40 is substantially the same as that of the primary molded portion 30. Therefore, detailed description of a method for forming the secondary molded portion 40 will be omitted, and here, only main differences between the primary molded portion 30 and the secondary molded portion 40, and a relationship between the primary molded portion 30 and the secondary molded portion 40 will be described. Note that FIG. 9 corresponds to FIG. 5(*a*), and a figure corresponding to FIG. 5(*b*) is omitted here. In FIG. 8 and the like illustrating the secondary molded portion 40, members corresponding to those of the primary molded portion 30 are denoted by the same reference numerals as those of the primary molded portion 30. However, in the secondary molded portion 40, "B" is used instead of a letter "A" in the primary molded portion 30.

Like the first resin portion 31 of the primary molded portion 30, a first resin portion 41 and a second resin portion 42 of the secondary molded portion 40 are respectively provided with a placement surface 41*a* and a placement surface 42*a*. A resin portion 47 is filled in a gap 46 between the adjacent second contact portions 62B. The placement surface 41*a* is provided with a protrusion 41*b* for defining the position of the shield plate 70. No protrusion is provided on the placement surface 42*a*. In this regard, as will be described below, the shield plate 70 is assembled in a state of being disposed between the placement surfaces 31*a*, 32*a* of the primary molded portion 30 and the placement surfaces 41*a*, 42*a* of the secondary molded portion 40. Therefore, if the protrusion is provided on any placement surface, the position of the shield plate 70 can be easily determined.

Figure 11:
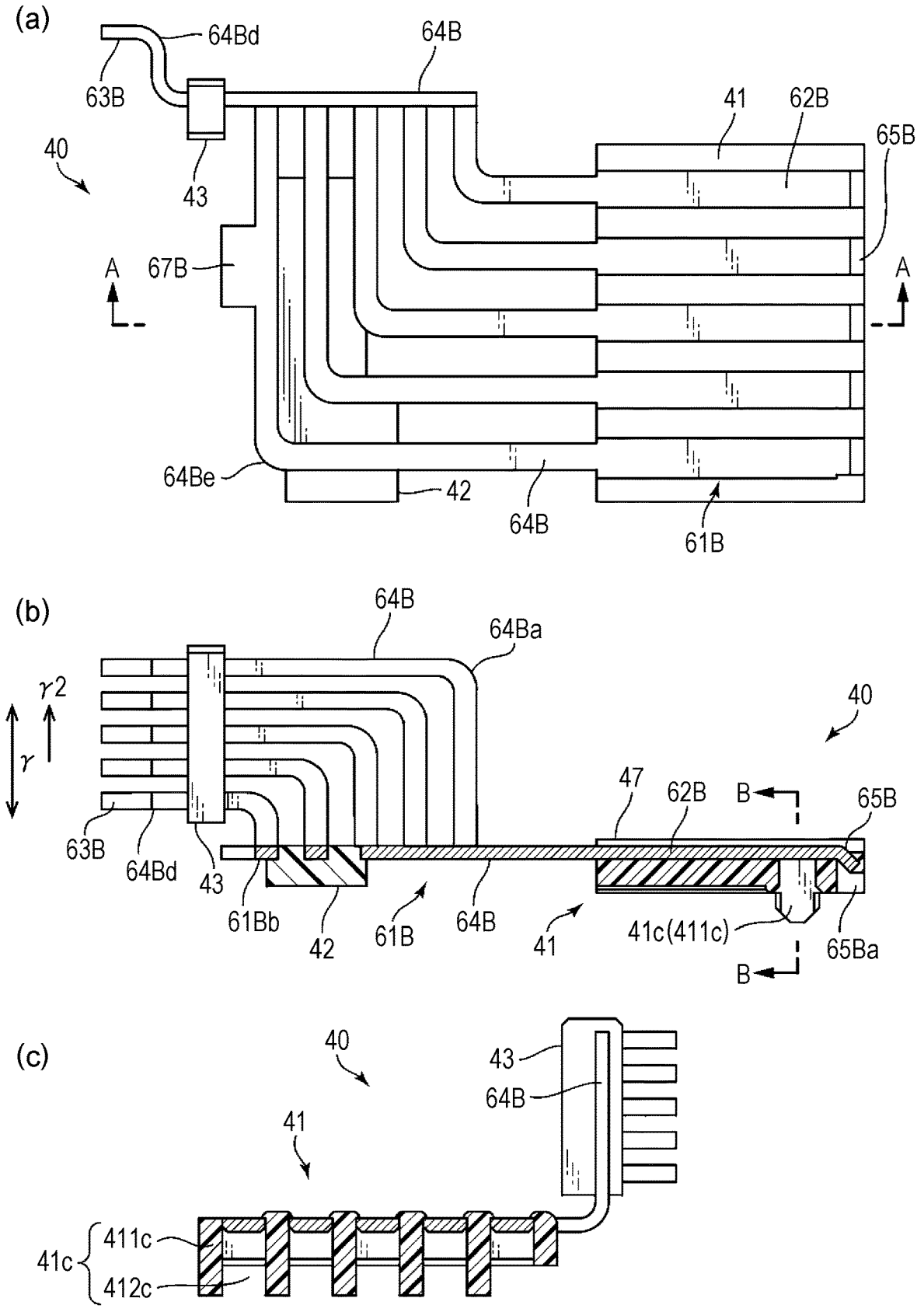
FIGS. 11(*a*), 11(*b*), 11(*c*) are views illustrating the step of forming the secondary molded portion and are views corresponding to FIGS. 7(*a*), 7(*b*), 7(*c*).

As well illustrated in FIG. 11(*c*), a second engaging portion 41*c* provided in the second resin portion 41 of the secondary molded portion 40 includes, for example, a protrusion 411*c* and a recess 412*c* in this order from the upper side to the lower side in the array direction "β" of the second contact portions 62B. Corresponding to this, as well illustrated in FIG. 7(*c*) described above, the first engaging portion 31*c* provided in the first resin portion 31 of the primary molded portion 30 includes, for example, the recess 312*c* and the protrusion 311*c* in this order from the upper side to the lower side in the array direction "β" of the first contact portions 62A. The second engaging portion 41*c* and the first engaging portion 31*c* have a complementary shape relationship with each other. When the primary molded portion 30 and the secondary molded portion 40 are combined in producing the housing 20 by forming the tertiary molded portion 80, the first engaging portion 31*c* of the primary molded portion 30 and the second engaging portion 41*c* of the secondary molded portion 40 mesh with each other in a staggered manner.

FIG. 12 is a view illustrating a state when the primary molded portion 30 and the secondary molded portion 40 are combined, and more specifically before they are combined, while the shield plate 70 is disposed between the primary molded portion 30 formed through the steps of FIGS. 4 to 7(*a*), 7(*b*), 7(*c*) and the secondary molded portion 40 formed through the steps of FIGS. 8 to 11(*a*), 11(*b*), 11(*c*), and FIG. 13 is a view illustrating a state after they are combined. FIG. 14 is a view illustrating a state after the housing 20 is produced by forming the tertiary molded portion 80 by integrally providing the combined primary molded portion 30 and secondary molded portion 40 by insert molding.

As is apparent from FIGS. 12 and 13, when the primary molded portion 30 and the secondary molded portion 40 are combined, the shield plate 70 carried by a carrier 75 is placed on the placement surface 31*a* and the like provided on the primary molded portion 30, and is placed on the placement surface 41*a* and the like provided on the secondary molded portion 40. Further, the position of the shield plate 70 is defined by the protrusion 31*c* and the like protruding from the placement surfaces. In this state, the first engaging portion 31*c* of the primary molded portion 30 and the second engaging portion 41*c* of the secondary molded portion 40 mesh with each other in a staggered manner. As a result, the shield plate 70 is reliably disposed at predetermined positions of the primary molded portion 30 and the secondary molded portion 40. In addition, the positional relationship between the primary molded portion 30 and the secondary molded portion 40 is easily and reliably determined.

When the shield plate 70 is placed on the placement surface 41*a* or the like and when the position of the shield plate 70 is defined by the protrusion 31*c* or the like, the shield plate 70 remains coupled to the carrier 25 through a coupling portion 73. Therefore, placement and positioning of the shield plate 70 can be easily performed. The shield plate 70, the coupling portion 73, and the carrier 25 are integrally formed by punching out the single metal plate, and are not bent afterward. Therefore, their manufacture is also easy. Since they are not bent, the shield plate 70, specifically the first shield portion 71 and the second shield portion 72, the coupling portion 73, and the carrier 25 are always present on the same plane. Since they are positioned on the same plane, subsequent processing is easy.

Finally, as illustrated in FIG. 14, the housing 20 is produced by forming the tertiary molded portion 80, in which the primary molded portion 30 and the secondary molded portion 40 are integrally provided with the shield plate 70 by insert molding. The third molded portion 80 functions at least as the first resin portion (first holding portion) 31 that integrally holds the first contact portion 62A, the first coupling portion 64A that couples the first contact portion 62A and the first connecting portion 63A, the first resin portion (second holding portion) 41 that integrally holds the second contact portion 62B, a second coupling portion 64B that couples the second contact portion 62B and the second connecting portion 63B, and the holding portion (third holding portion) that integrally holds the shield plate 70. At this time, the coupling portion 73 that couples the carrier 75 and the shield plate 70 is exposed from a portion other than the exposed portions of the fitting portion 21, the first contact portion 62A and the second contact portion 62B, in a peripheral edge 74 (FIGS. 12 and 13) of the housing 20 surrounding a plate thickness of the shield plate 70. Thereafter, after the housing 20 is cut off from the carrier 75 at the coupling portion 73, the shell 50 is attached to the housing 20 as needed. As a result, the coupling portion 73 exposed from the housing 20 is also covered together with the housing 20 by the shell 50, to be shielded from the outside. When the tertiary molded portion 80 is formed, the main body portion 22 side of the housing 20 is filled with the resin. At the same time, at least a gap 51 formed between the one surface 21*a* and the other surface 21*b* of the fitting portion 21 is filled with the resin. The gap 51 includes, for example, a peripheral edge of the one surface 21*a* and the other surface 21*b* of the fitting portion 21, more specifically, a gap in a peripheral edge portion of the fitting portion 21, which is formed by a front side 55*a* and a side surface 55*b* of the fitting portion 21 and is substantially U-shaped in a plan view. Specifically, the gap of the front side 55*a* includes a gap at the end portion 65A of the first terminal 61A on the side fitting with the mating connector, more specifically, a recess 65Aa formed on the secondary molded portion 40 side from the end portion 65A in the thickness direction "γ" of the fitting portion 21, and a gap at an end portion 65B of the second terminal 61B on the side fitting with the mating connector, more specifically, a recess 65Ba formed on the primary molded portion 30 side from the end portion 65B in the thickness direction "γ" of the fitting portion 31. The recesses 65Aa and 65Ba are respectively formed by holding the terminals 60 by the mold when insert-molding the primary molded portion 30 and the secondary molded portion 40. When the tertiary molded portion 80 is formed, the recesses 65Aa and 65Ba are also filled with the resin.

The present invention is not limited to the above embodiment, and various other modifications can be made.

For example, in the embodiment described above, the shield plate 70 is integrally provided as a part of the tertiary molded portion 80 by insert molding together with the primary molded portion 30 and the secondary molded portion 40. Not limited to this, the shield plate 70 may be integrally provided as a part of the primary molded portion 30 by insert molding together with the first contact portions 62A. Alternatively, the shield plate 70 may be integrally provided as a part of the secondary molded portion 40 by insert molding together with the second contact portions 62B.

Further, in the above-described embodiment, the gap 36 (see FIG. 4) between the adjacent first contact portions 62A is filled with the resin during insert molding for forming the primary molded portion 30, and similarly, the gap 46 (see FIG. 8) between the adjacent second contact portions 62B is filled with the resin during insert molding for forming the secondary molded portion 40. In this regard, they may be filled with the resin when forming the tertiary molded portion 80.

In the above-described embodiment, a bending step may of course be performed at any time as long as other steps are not hindered.

LIST OF REFERENCE SIGNS

1: Electric connector, 20: Housing, 21: Fitting portion, 21*a*: One surface, 21*b*: The other surface, 22: Main body portion, 25: Fitting port, 30: Primary molded portion, 31: First resin portion, 31*a*: Placement surface, 31*c*: First engaging portion, 311*c*: Protrusion, 312*c*: Recess, 32: Second resin portion, 32*a*: Placement surface, 32*b*: Protrusion, 33: Resin portion, 36: Gap, 40: Secondary molded portion, 41: First resin portion, 41*a*: Placement surface, 41*c*: Second engaging portion, 411*c*: Protrusion, 412*c*: Recess, 42: Second resin portion, 42*a*: Placement surface, 43: Resin portion, 51: Gap, 50: Shell, 60: Terminal, 61A: First terminal, 62A: First contact portion, 63A: First connecting portion, 65A: End portion, 61B: Second terminal, 62B: Second contact portion, 63B: Second connecting portion, 64B: Second coupling portion, 65B: End portion, 70: Shield plate, 80: Tertiary molded portion.

The invention claimed is:

1. A method for manufacturing an electric connector, the electric connector comprising:

a housing including a plate-shaped fitting portion that fits with a mating connector;

a plurality of first terminals each having a first contact portion that is disposed on one surface of the fitting portion and can contact the mating connector when fitting with the mating connector;

a plurality of second terminals each having a second contact portion that is disposed on the other surface opposite to the one surface of the fitting portion and can contact the mating connector when fitting with the mating connector; and a shield plate disposed between the first contact portion and the second contact portion, the method for manufacturing the electric connector, comprising:

a step of forming a primary molded portion in which the first contact portions are integrally provided by insert molding, in a state where the plurality of first terminals are connected to each other by a first intermediate coupling portion;

a step of forming a secondary molded portion in which the second contact portions are integrally provided by insert molding, in a state where the plurality of second terminals are connected to each other by a second intermediate coupling portion;

a step of cutting out the first intermediate coupling portion after forming the primary molded portion;

a step of cutting out the second intermediate coupling portion after forming the secondary molded portion; and a step of producing the housing by forming a tertiary molded portion in which the primary molded portion and the secondary molded portion are integrally provided by insert molding, wherein the shield plate is integrally provided with the first contact portions by insert molding as a part of the primary molded portion, or integrally provided with the second contact portions by insert molding as a part of the secondary molded portion, or integrally provided with the primary molded portion and the secondary molded portion by insert molding as a part of the tertiary molded portion.

2. The method for manufacturing the electric connector according to claim 1, wherein in the step of forming the primary molded portion, a first engaging portion is integrally formed as a part of the primary molded portion, in the step of forming the secondary molded portion, a second engaging portion is integrally formed as a part of the secondary molded portion, and in the step of producing the housing by forming the tertiary molded portion, the first engaging portion and the second engaging portion are engaged with each other.

3. The method for manufacturing the electric connector according to claim 2, wherein the first engaging portion is a protrusion or a recess, and the second engaging portion corresponding to the first engaging portion is the recess or the protrusion.

4. The method for manufacturing the electric connector according to claim 2, wherein the step of producing the housing by forming the tertiary molded portion includes filling resin into a gap formed between the primary molded portion and the secondary molded portion at a peripheral edge of the one surface and the other surface of the fitting portion.

5. The method for manufacturing the electric connector according to claim 4, wherein the peripheral edge is substantially U-shaped in a plan view.

6. The method for manufacturing the electric connector according to claim 1, wherein the step of forming the primary molded portion includes filling resin into a gap between the first contact portions adjacent to each other, and/or the step of forming the secondary molded portion includes filling the resin into a gap between the second contact portions adjacent to each other.

7. The method for manufacturing the electric connector according to claim 6, wherein a resin portion filled in the gap between the first contact portions adjacent to each other protrudes from the first contact portions to a side opposite to the secondary molded portion in the thickness direction of the fitting portion, and/or a resin portion filled in the gap between the second contact portions adjacent to each other protrudes from the second contact portions to a side opposite to the primary molded portion in the thickness direction of the fitting portion.

8. The method for manufacturing the electric connector according to claim 1, wherein the step of forming the primary molded portion includes covering an end portion on a side fitting with the mating connector of the first terminal with resin on the side fitting with the mating connector, and/or the step of forming the secondary molded portion includes covering an end portion on a side fitting with the mating connector of the second terminal with the resin on the side fitting with the mating connector.

9. The method for manufacturing the electric connector according to claim 1, wherein the step of producing the housing by forming the tertiary molded portion includes filling, in an end portion on a side fitting with the mating connector of the first terminal, resin in a recess formed on the secondary molded portion side from the end portion, in the thickness direction of the fitting portion, and/or the step of producing the housing by forming the tertiary molded portion includes filling, in an end portion on a side fitting with the mating connector of the second terminal, the resin in a recess formed on the primary molded portion side from the end portion, in the thickness direction of the fitting portion.

10. The method for manufacturing the electric connector according to claim 1, wherein the first terminal has a first connecting portion exposed from the housing, and the step of forming the primary molded portion includes a step of bending the first connecting portions so that an array direction of the first contact portions and an array direction of the first connecting portions are perpendicular to each other, and/or the second terminal has a second connecting portion exposed from the housing, and the step of forming the secondary molded portion includes a step of bending the second connecting portions so that an array direction of the second contact portions and an array direction of the second connecting portions are perpendicular to each other.

11. The method for manufacturing the electric connector according to claim 10, wherein in the step of forming the primary molded portion, the first connecting portions are integrally held by a resin portion, and/or in the step of forming the secondary molded portion, the second connecting portions are integrally held by the resin portion.

12. The method for manufacturing the electric connector according to claim 10, wherein the first connecting portions integrally held are integrally bent with respect to the first contact portions, and/or the second connecting portions integrally held are integrally bent with respect to the second contact portions.

13. The method for manufacturing the electric connector according to claim 1, wherein when the shield plate is provided integrally with the primary molded portion and the secondary molded portion as a part of the tertiary molded portion by insert molding, a first placement surface on which the shield plate is placed is formed in the primary molded portion in the step of forming the primary molded portion, and/or when the shield plate is provided integrally with the primary molded portion and the secondary molded portion as a part of the tertiary molded portion by insert molding, a second placement surface on which the shield plate is placed is formed in the secondary molded portion in the step of forming the secondary molded portion.

14. The method for manufacturing the electric connector according to claim 13, wherein the first placement surface is provided with a protrusion that defines a position of the shield plate in the first placement surface, in at least one of a fitting direction with the mating connector, an array direction of the first contact portions, and the thickness direction of the fitting portion, and/or the second placement surface is provided with a protrusion that defines a position of the shield plate in the second placement surface, in at least one of the fitting direction with the mating connector, an array direction of the second contact portions, and the thickness direction of the fitting portion.

15. The method for manufacturing the electric connector according to claim 12, wherein the first terminal has a first coupling portion located between the first contact portion and the first connecting portion, and the first placement surface is formed by at least a first resin portion integrally holding the first contact portions and a second resin portion integrally holding the first coupling portions, the first and second resin portions being separated from each other, and/or the second terminal has a second coupling portion located between the second contact portion and the second connecting portion, and the second placement surface is formed by at least a third resin portion integrally holding the second contact portions and a fourth resin portion integrally holding the second coupling portions, the third and fourth resin portions being separated from each other.

16. An electric connector comprising:

a housing including a plate-shaped fitting portion that fits with a mating connector;

a plurality of first terminals each having a first contact portion that is disposed on one surface of the fitting portion and can contact the mating connector when fitting with the mating connector;

a plurality of second terminals each having a second contact portion that is disposed on the other surface opposite to the one surface of the fitting portion and can contact the mating connector when fitting with the mating connector; and a shield plate disposed between the first contact portion and the second contact portion, wherein a part of the shield plate is exposed in a plate shape from the housing, each of the plurality of first terminals further has a first connecting portion exposed from the housing, each of the plurality of second terminals further has a second connecting portion exposed from the housing, and the electric connector further comprises:

a first resin portion that integrally holds the first contact portions;

a second resin portion that integrally holds the first connecting portions, the first resin portion and the second resin portion being physically separated from each other;

a third resin portion that integrally holds the second contact portions; and a fourth resin portion that integrally holds the second connecting portions, the third resin portion and the fourth resin portion being physically separated from each other.

17. The electric connector according to claim 16, wherein a part of the shield plate is on the same plane as a shield portion of the shield plate disposed between the first contact portion and the second contact portion.

18. The electric connector according to claim 16, wherein a part of the shield plate is exposed from a portion other than the fitting portion and exposed portions of the first connecting portion and the second connecting portion in a peripheral edge surrounding a plate thickness of the shield plate of the housing.

19. An electric connector comprising:

a housing including a plate-shaped fitting portion that fits with a mating connector;

a plurality of first terminals each having a first contact portion, and a first coupling portion coupling the first contact portion and a first connecting portion;

a plurality of second terminals each having a second contact portion, and a second coupling portion coupling the second contact portion and a second connecting portion; and a shield plate disposed between the first contact portion and the second contact portion, wherein the housing comprises:

a first holding portion made of resin, which integrally holds the first contact portions, a second holding portion made of the resin, which integrally holds the second contact portions, a first resin portion which integrally holds at least a part of the first coupling portions adjacent to each other, the first resin portion being physically separated from the first holding portion, a second resin portion which integrally holds at least a part of the second coupling portions adjacent to each other, the second resin portion being physically separated from the second holding portion, and a third holding portion made of the resin, which integrally holds the first and second holding portions, the first coupling portion, the second coupling portion, and the shield plate.

* * * * *